US011684102B2

(12) United States Patent
Lazic et al.

(10) Patent No.: US 11,684,102 B2
(45) Date of Patent: Jun. 27, 2023

(54) WAISTBAND FOR A GARMENT

(71) Applicant: LULULEMON ATHLETICA CANADA INC., Vancouver (CA)

(72) Inventors: Natasa Lazic, Vancouver (CA); Olga Vysotska, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 31 days.

(21) Appl. No.: 17/210,888

(22) Filed: Mar. 24, 2021

(65) Prior Publication Data

US 2021/0298396 A1 Sep. 30, 2021

Related U.S. Application Data

(60) Provisional application No. 63/001,312, filed on Mar. 28, 2020.

(51) Int. Cl.
*A41D 27/20* (2006.01)
*A41D 1/08* (2018.01)

(52) U.S. Cl.
CPC ..... *A41D 27/20* (2013.01); *A41D 1/08* (2013.01)

(58) Field of Classification Search
CPC ..... A41D 27/204; A41D 1/085; A41D 27/20; A41D 1/08; A41D 27/205; A41D 27/207; A41D 27/201; A41D 1/06; A41F 9/00; A41F 9/005; A41F 9/002
USPC ..... 2/236; 450/150
See application file for complete search history.

(56) References Cited

U.S. PATENT DOCUMENTS

| | | | | | |
|---|---|---|---|---|---|
| 849,060 | A * | 4/1907 | Friedbaum | A41F 9/00 | 2/235 |
| 1,920,061 | A * | 7/1933 | Carr | A45C 11/22 | 224/660 |
| 3,042,932 | A * | 7/1962 | Eppy | A41F 9/00 | 2/258 |
| 4,428,080 | A * | 1/1984 | Takamatsu | A41D 27/20 | 2/247 |
| 2015/0257459 | A1* | 9/2015 | Cockram | A41D 27/20 | 2/237 |
| 2017/0238634 | A1* | 8/2017 | Berns | A41D 1/085 | |

* cited by examiner

*Primary Examiner* — Katherine M Moran
*Assistant Examiner* — Grady Alexander Nunnery
(74) *Attorney, Agent, or Firm* — Conneely PC; Joseph Conneely

(57) ABSTRACT

Examples of a waistband for a garment are disclosed, the waistband having a front portion, a back portion, and a curved top edge at the waist opening that curves gradually downward forming a concave curve at the front portion of the waistband and curves gradually upward forming a convex curve at the back portion of the waistband. Also disclosed is a lower body garment having a waistband, the waistband having one or more storage means (or pockets) formed therein and a curved edge at the waist opening, the storage means being concealed by respective loops formed over the waistband.

7 Claims, 11 Drawing Sheets

SECTION A-A

SECTION B-B

WAISTBAND FOR A GARMENT

This application claims priority from and the benefit of the filing date of U.S. Provisional Patent Application No. 63/001,312, filed Mar. 28, 2020, and the entire content of such application is incorporated herein by reference.

TECHNICAL FIELD

This application relates to the field of garments, and more specifically, to a garment for sporting activities, exercise, and the like that has a waistband with one or more storage means formed therein and with a curved edge at the waist opening.

BACKGROUND

Athletes and consumers are demanding high performance activewear and sportswear, such as for example, tights, pants, and shorts. Currently, many such garments do not fit well around a wearer's waist and require frequent adjustment by the wearer. In addition, such garments should be as snug as possible but must still provide adequate room for holding personal items such as smart phones and keys. Currently, many such garments have pockets located in positions that interfere with a wearer's movements. In addition, such pockets often do not adequately secure valuable personal items, such as smart phones and keys, when the wearer is engaged in stretching, exercising, and athletic performance.

SUMMARY OF THE APPLICATION

In one aspect, a waistband for a garment is provided, the waistband having a front portion, a back portion, and a curved top edge at the waist opening that curves gradually downward forming a concave curve at the front portion of the waistband and curves gradually upward forming a convex curve at the back portion of the waistband.

In another aspect, a lower body garment is provided, the waistband having one or more storage means (or pockets) formed therein and a curved edge at the waist opening, the storage means being concealed by respective loops formed over the waistband.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

DETAILED DESCRIPTION

In the following description, details are set forth to provide an understanding of the application. In some instances, certain structures, techniques, and methods have not been described or shown in detail in order not to obscure the application.

Figure 1:
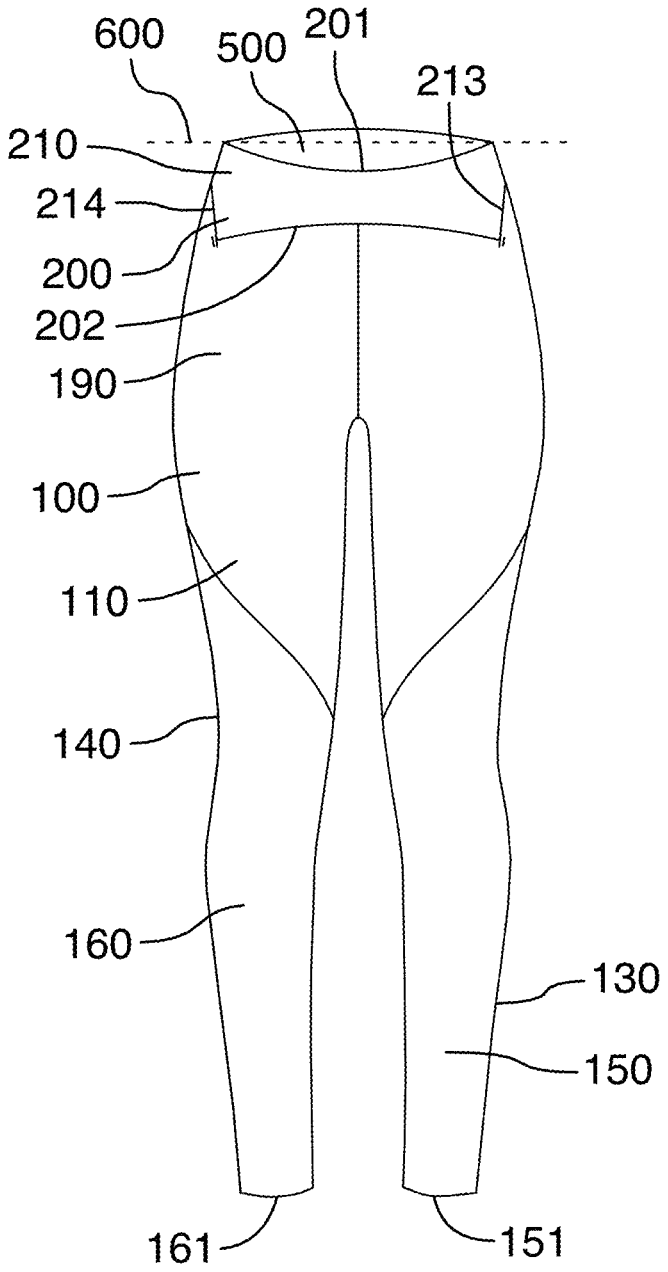
FIG. 1 is a front view illustrating an example of a garment having a waistband, the waistband having one or more concealed storage means formed therein and a curved edge at the waist opening.
Figure 2:
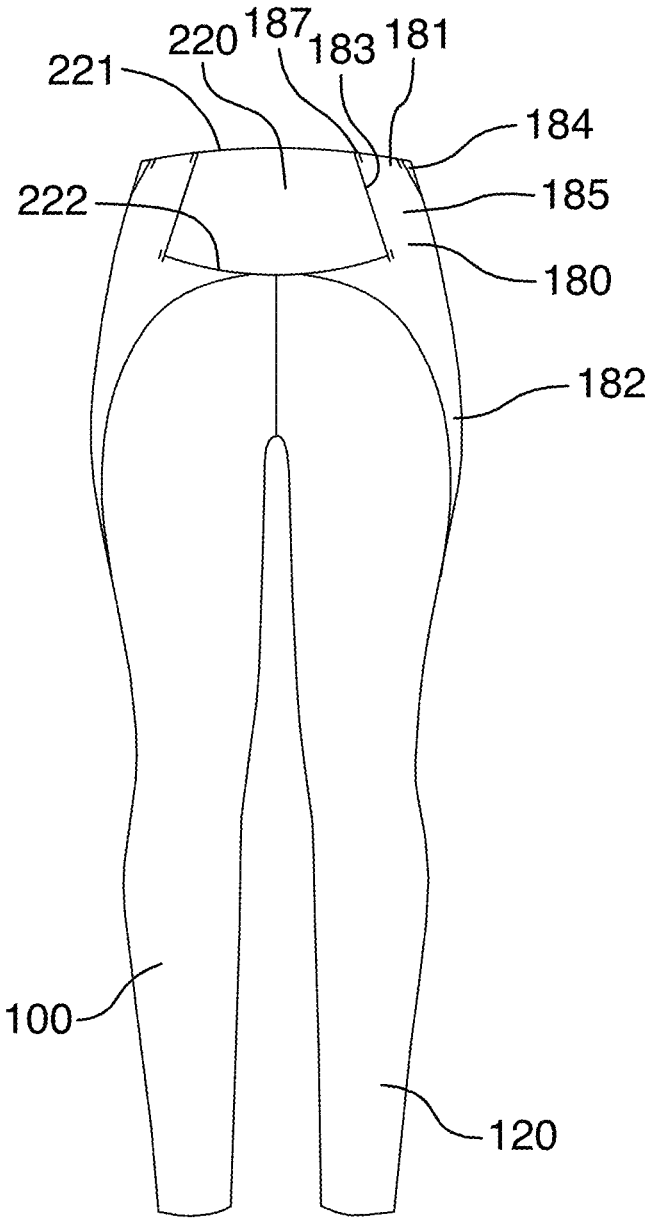
FIG. 2 is a rear view thereof.
Figure 3:
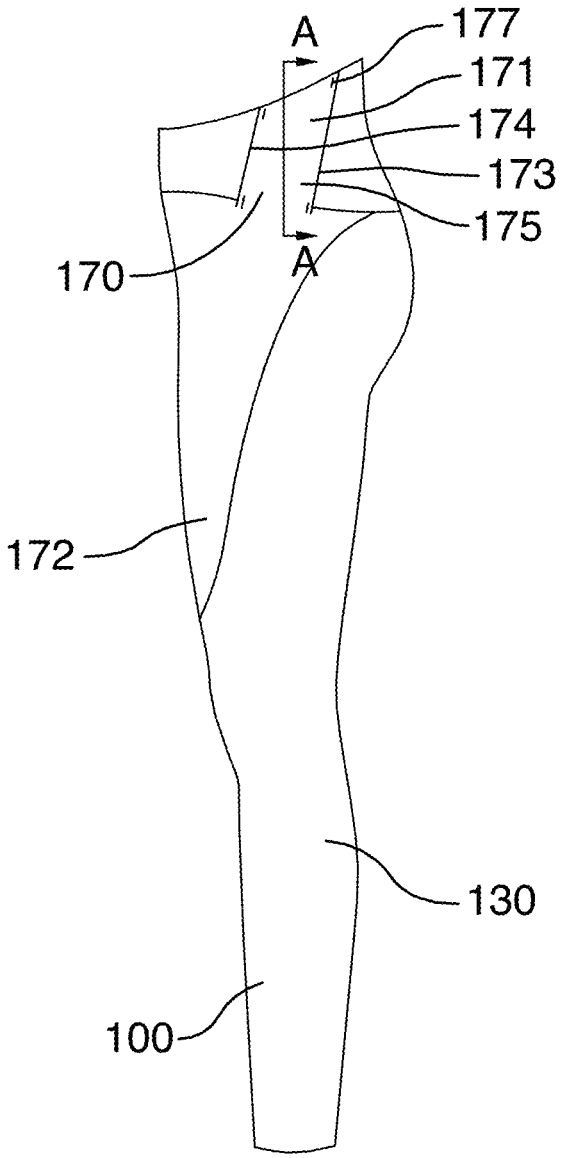
FIG. 3 is a right side view thereof, the left side view being a mirror image thereof.
Figure 4:
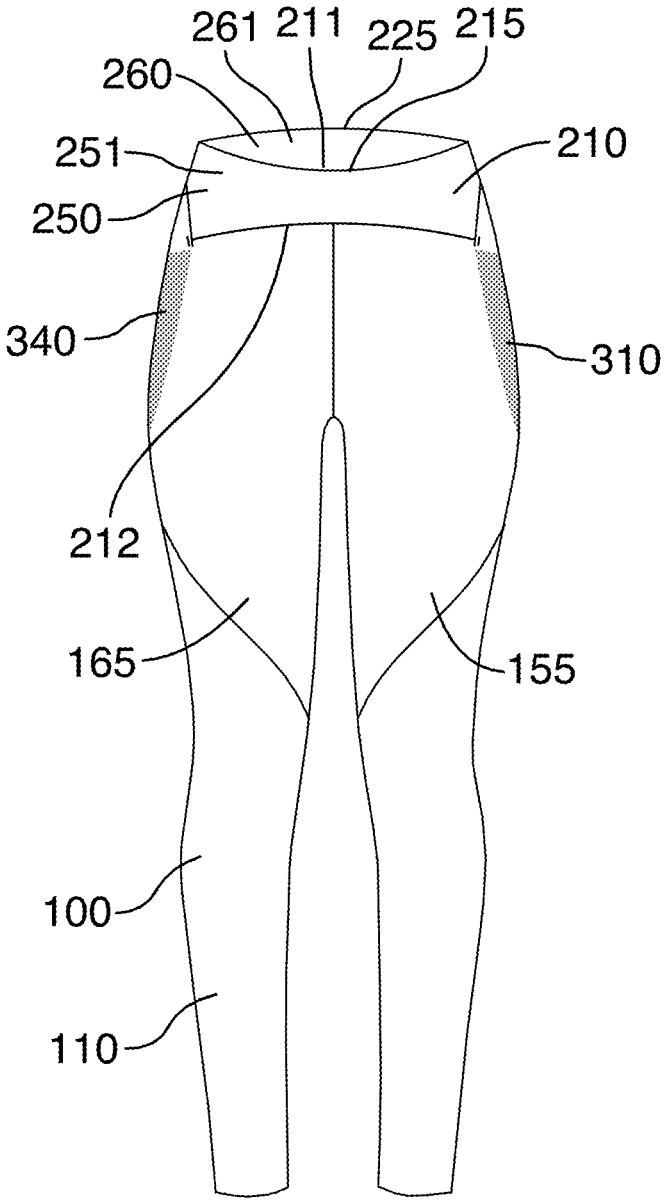
FIG. 4 is a front view thereof showing the concealed storage means thereof in a contrasting tone.
Figure 5:
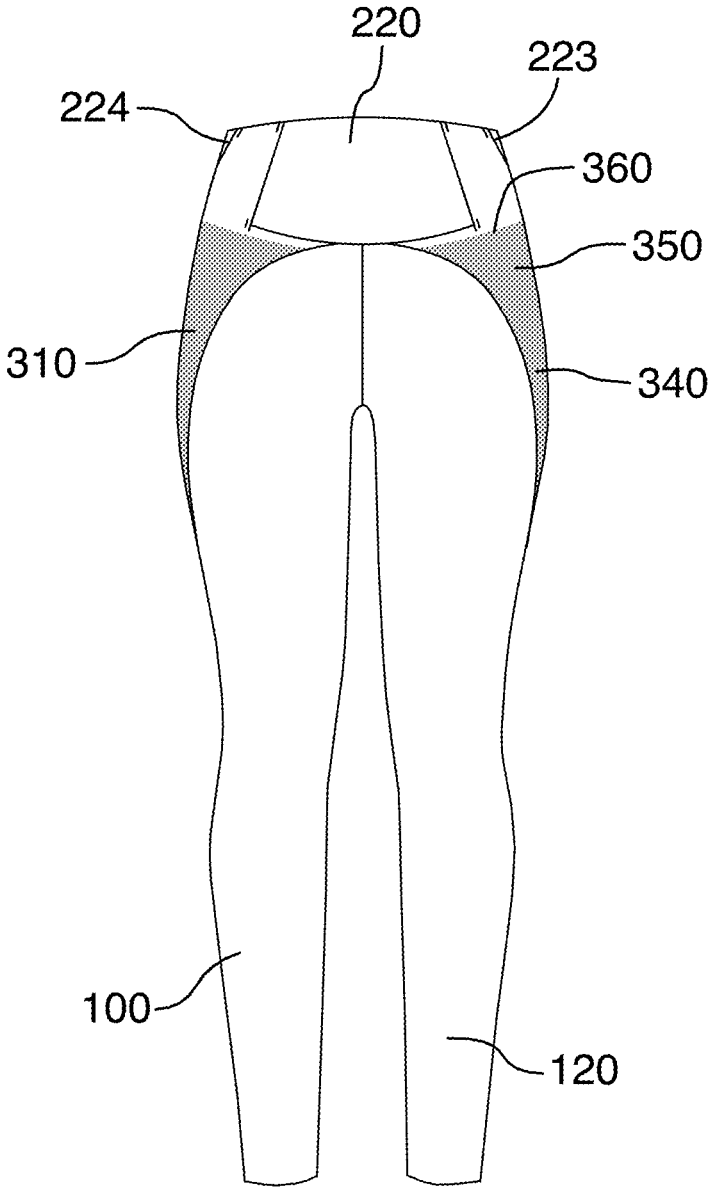
FIG. 5 is a rear view thereof.
Figure 6:
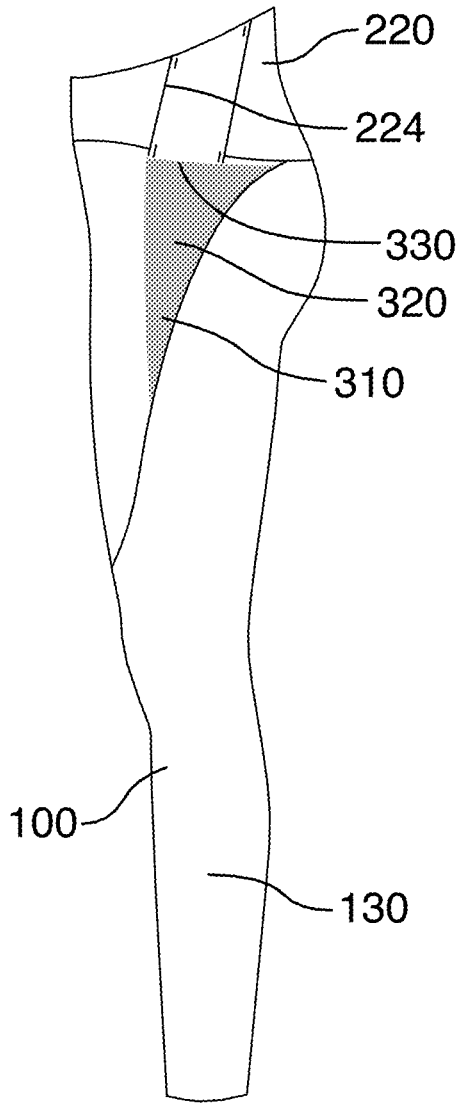
FIG. 6 is a right side view thereof, the left side view being a mirror image thereof.
Figure 7:
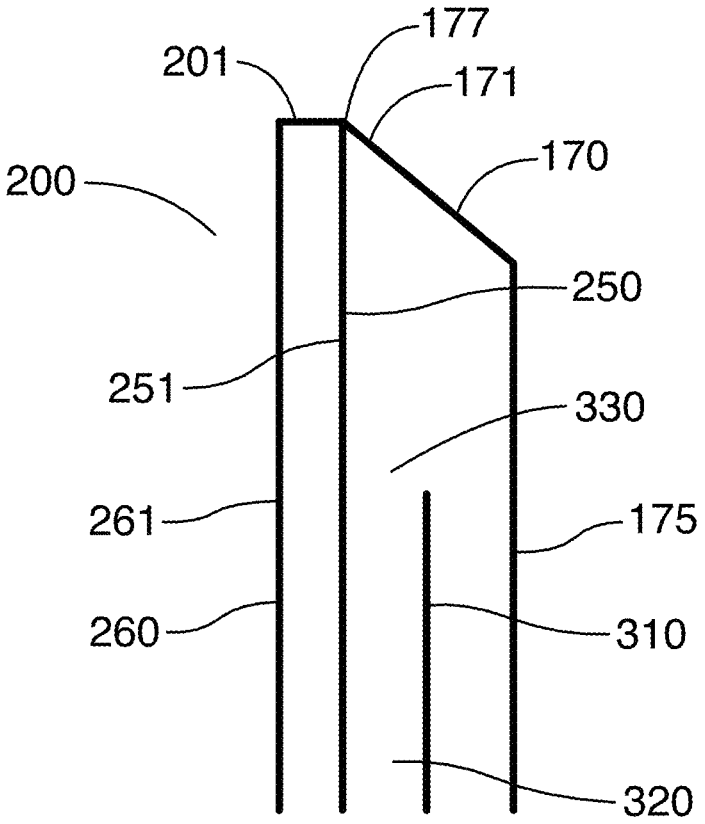
FIG. 7 is a cross-sectional detail view of the first loop of the waistband of the garment of FIG. 1 taken along line A-A in FIG. 3.

FIG. 1 is a front view illustrating an example of a garment 100 having a waistband 200, the waistband 200 having one or more storage means (or pockets) 320, 350 formed therein and a curved edge 201 at the waist opening 500. FIG. 2 is a rear view thereof. FIG. 3 is a right side view thereof, the left side view being a mirror image thereof. FIG. 4 is a front view thereof showing the concealed storage means (or pockets) 320, 350 thereof in a contrasting tone. FIG. 5 is a rear view thereof. FIG. 6 is a right side view thereof, the left side view being a mirror image thereof. And, FIG. 7 is a cross-sectional detail view of the first loop 175 of the waistband 200 of the garment 100 of FIG. 1 taken along line A-A in FIG. 3.

As shown in FIGS. 1-3, the garment (or lower body garment) 100 has a front side 110, back side 120, right side 130, and left side 140. A waistband 200 extends around a waist opening 500 and is connected (e.g., attached, sewn, glued, bonded, coupled, joined, etc.) along a bottom edge 202 of the waistband 200 to a body (or pelvic) portion 190 which includes first and second (or right and left) legs (or leg portions) 150, 160 having respective leg opening 151, 161. As further described below, a top edge 201 of the waistband 200 at the waist opening 500 is curved (or inclined, sloped, slanted, tilted, etc.) downwards from each side 130, 140 of the garment 100 to the front side 110 of the garment 100 with respect to a nominal horizontal waistline 600 of a wearer. As shown in FIGS. 4-7, the waistband 200 may have one or more storage means (or pockets) 320, 350 formed therein which are concealed by respective loop panels 170, 180 as further described below. The garment 100 may be a pair of tights, shorts, pants, or the like.

In one example embodiment, a waistband 200 for a garment 100 is disclosed as follows. The waistband 200 includes a front portion (or fabric panel) 210 for covering at least a portion of an abdomen area of a wearer, the front portion 210 having a first (or right) side 213 and a second (or left) side 214. The waistband 200 also has a back portion (or fabric panel) 220 for covering at least a portion of a lower back area of the wearer, the back portion having a first (or right) side 223 and a second (or left) side 224. The first and second (or right and left) sides (or side edges) 213, 214 of the front portion 210 are connected (e.g., attached, sewn, glued, bonded, coupled, joined, etc.) to the respective second and first sides (or side edges) 224, 223 of the back portion 220.

The waistband 200 has a top (or upper) edge 201 formed by respective top edges 211, 221 of the front portion 210 and the back portion 220. In addition, the waistband 200 has a bottom (or lower) edge 202 formed by respective bottom edges 212, 222 of the front portion 210 and the back portion 220. The top edge 201 curves gradually downward from each of the first and second sides 213, 214 of the front portion 210 to a central portion 215 of the top edge 211 of the front portion 210 and curves gradually upward from each of the first and second sides 223, 224 of the back portion 220 to a central portion 225 of the top edge 221 of the back portion 220.

In one embodiment, the central portion 215 of the top edge 211 of the front portion 210 is positioned to fit below the waistline 600 of the wearer and the central portion 225 of the top edge 221 of the back portion 220 is positioned to fit at or proximate the waistline 600 of the wearer. In another embodiment, the central portion 215 of the top edge 211 of the front portion 210 is positioned to fit below the waistline 600 of the wearer and the central portion 225 of the top edge 221 of the back portion 220 is positioned to fit above the waistline 600 of the wearer. In a further embodiment, the central portion 215 of the top edge 211 of the front portion 210 is positioned to fit at or proximate the waistline 600 of the wearer and the central portion 225 of the top edge 221 of the back portion 220 is positioned to fit above the waistline 600 of the wearer.

The waistband 200 can have an outer panel (or fabric panel or liner) 251 and an inner panel (or fabric panel or liner) 261. The outer and inner panels 251, 261 form respective outer and inner surfaces 250, 260 of the front and back portions 210, 220 and can be connected together at least along a portion of the top edge 201 and the bottom edge 202 of the waistband 200.

The waistband 200 further includes a first (or right) loop panel 170 connected to the outer surface 250 of the waistband 200 and forming a first loop 175 and a second (or left) loop panel 180 connected to the outer surface 250 of the waistband 200 and forming a second loop 185. The first loop 175 may be positioned at a predetermined distance from the second loop 185 along the circumference of the waist opening 500 of the garment 100. For example, the first and second loops 175, 185 may be positioned over the waistband 200 on either side 130, 140 of the garment 100. Front 174, 184 and rear edges 173, 183 of the first and second loops 175, 185 may be left open (i.e., not attached) over the waistband 200 to provide access to the storage means (or pockets) 320, 350 located thereunder as further described below. In addition, the loops 175, 185 can also be used to put a towel, a jacket or a shirt therethrough so that the wearer can carry such items secured by the loops 175, 185.

In another example embodiment, a lower body garment 100 is disclosed as follows. The lower body garment 100 includes a pelvic portion (or body) 190 having a waist opening 500 and a pair of leg openings 151, 161 formed therein and a waistband 200. The waistband 200 has a bottom edge 202 connected to the pelvic portion 190 at the waist opening 500 and a top edge 201. The waistband 200 also has a front waistband portion (or fabric panel) 210 having a first (or right) side 213 and a second (or left) side 214. A top edge 211 of the front waistband portion 210 forms a concave curve between the first and the second sides 213, 214 of the front waistband portion 210. The waistband 200 also has a back waistband portion (or fabric panel) 220 having a first (or right) side 223 connected to the second side 214 of the front waistband portion 210 and a second (or left) side 224 connected to the first side 213 of the front waistband portion 210. A top edge 221 of the back waistband portion 220 forms a convex curve between the first and the second sides 223, 224 of the back waistband portion 220.

In one embodiment, a lowest (or central) portion 215 of the concave curve of the top edge 211 of the front waistband portion 210 is positioned to fit below the waistline 600 of a wearer and a highest (or central) portion 225 of the convex curve of the top edge 221 of the back waistband portion 220 is positioned to fit at or proximate the waistline 600 of the wearer. In another embodiment, a lowest (or central) portion 215 of the concave curve of the top edge 211 of the front waistband portion 210 is positioned to fit below the waistline 600 of a wearer and a highest portion 225 of the convex curve of the top edge 221 of the back waistband portion 220 is positioned to fit above the waistline 600 of the wearer. In a further embodiment, a lowest portion 215 of the concave curve of the top edge 211 of the front waistband portion 210 is positioned to fit at or proximate the waistline 600 of a wearer and a highest portion 215 of the convex curve of the top edge 221 of the back waistband portion 220 is positioned to fit above the waistline 600 of the wearer.

The lower body garment 100 further includes a first (or right) loop panel 170 having a top (or upper) end 171 connected to an outer surface 250 of the waistband 200 and a bottom (or lower) end 172, the first loop panel 170 forming a first loop 175. The lower body garment 200 also includes a second (of left) loop panel 180 having a top (or upper) end 181 connected to the outer surface 250 of the waistband 200 and a bottom (or lower) end 182, the second loop panel 180 forming a second loop 185. The first loop 175 may be positioned at a predetermined distance from the second loop 185 along a circumference of the waist opening 500. For example, the first and second loops 175, 185 may be positioned over the waistband 200 on either side 130, 140 of the garment 100. The bottom end 172 of the first loop panel 170 can be connected to an outer surface 155 of a first leg portion (or leg) 150 of the lower body garment 100 and the bottom end 182 of the second loop panel 180 can be connected to an outer surface 165 of a second leg portion (or leg) 160 of the lower body garment 100.

As shown in FIGS. 4-7, the lower body garment 100 also includes a pocket panel 310, 340 connected to the outer surface 155, 165 of at least one of the first and second leg portions 150, 160 forming a storage means (or pocket or pocket bag) 320, 350 having an entrance opening 330, 360. The entrance opening 330, 360 is concealed by at least a portion (e.g., the loops 175, 185 extending over the waistband 200) of at least one of the respective first and second loop panels 170, 180.

In a further example embodiment, a lower body garment 100 is disclosed as follows. The lower body garment 200 includes a pelvic portion 190 having a waist opening 500 and a pair of leg openings 151, 161 formed therein. The waistband 200 has a bottom edge 202 connected to the pelvic portion 190 at the waist opening 500 and a top edge 201. The waistband 200 also has an outer panel (or liner) 251 and an inner panel (or liner) 261. The outer panel 251 and the inner panel 261 are connected at least along a portion of the top edge 201 and the bottom edge 202 of the waistband 200. The waistband 200 also has a first (or right) loop panel 170 having a top (or upper) end 171 connected to the waistband 200 at least at one connection point 177 (e.g., along the top edge 201) and a bottom (or lower) end 172, the first loop panel 170 forming a first loop 175. The waistband 200 also has a second (or left) loop panel 180 having a top (or upper) end 181 connected to the waistband 200 at least at another connection point 187 (e.g., along the top edge 201) and a bottom (or lower) end 182, the second loop panel 180 forming a second loop 185. The first loop 175 may be positioned at a predetermined distance from the second loop 185 along a circumference of the waist opening 500.

In the above lower body garment 100, the bottom end 172 of the first loop panel 170 is connected to an outer surface 155 of a first leg portion (or leg) 150 of the lower body garment 100 and the bottom end 182 of the second loop panel 180 is connected to an outer surface 165 of a second leg portion (or leg) 160 of the lower body garment 100. The lower body garment 100 also includes a pocket panel 310, 340 connected to the outer surface 155, 165 of at least one of the first and second leg portions 150, 160 forming a storage means (or pocket or pocket bag) 320, 350 having an entrance opening 330, 360. The entrance opening 330, 360 is concealed by at least a portion (e.g., the loops 175, 185 extending over the waistband 200) of at least one of the respective first and second loop panels 170, 180.

Figure 8:
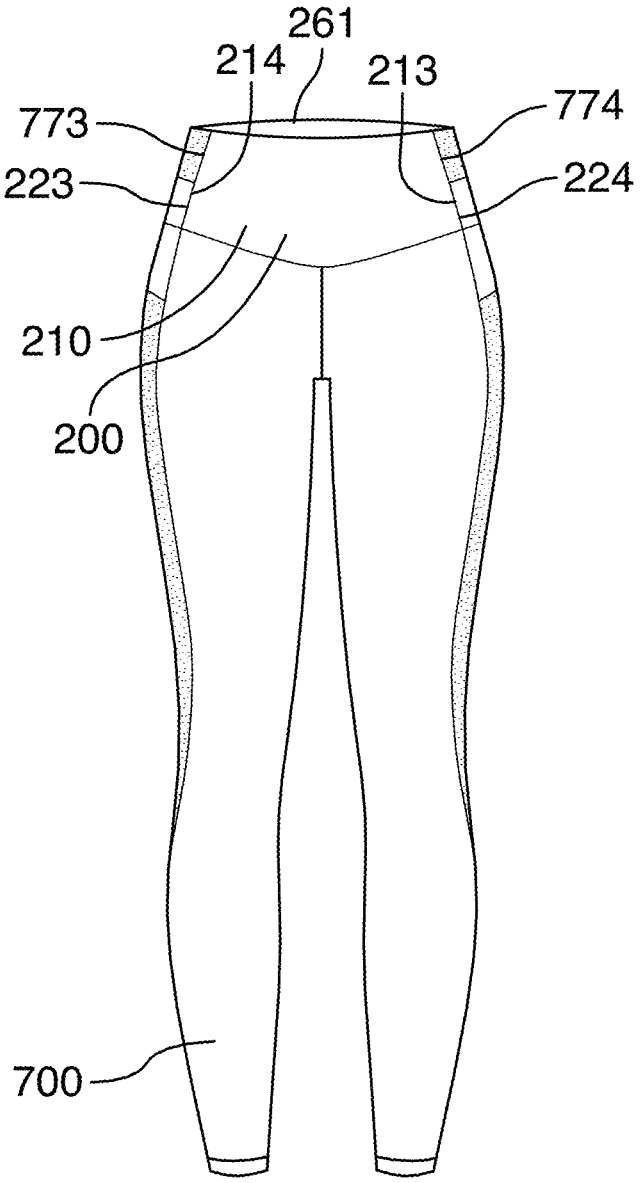
FIG. 8 is a front view illustrating another example of a garment having a waistband, the waistband having a loop formed on the back portion thereof.
Figure 9:
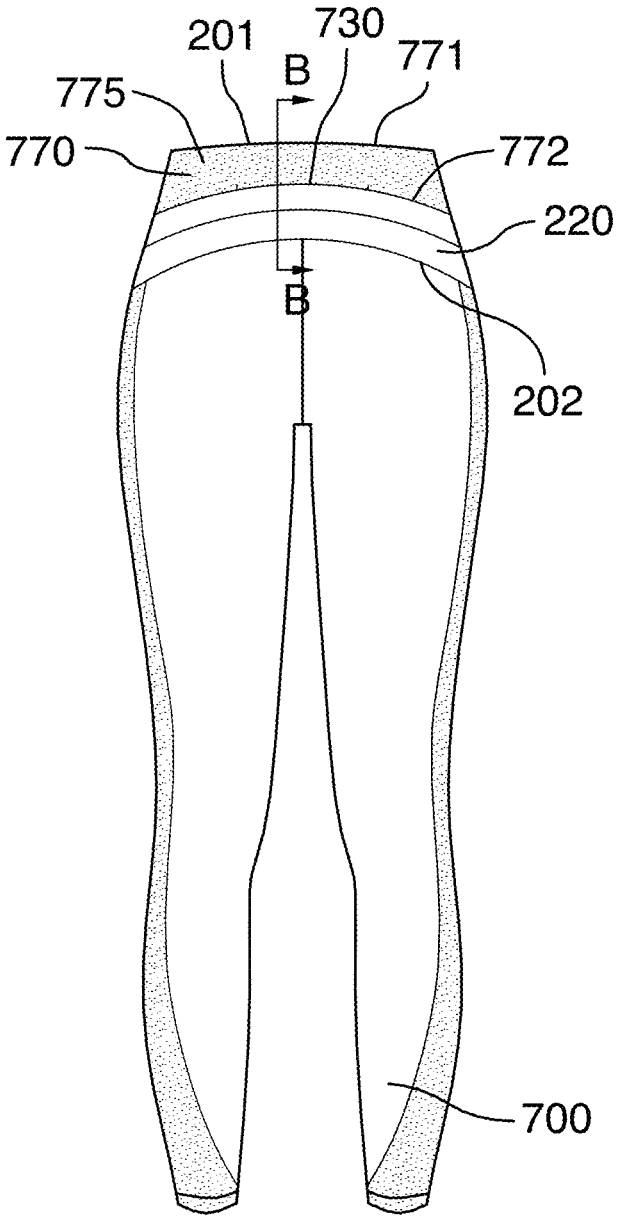
FIG. 9 is a rear view thereof.
Figure 10:
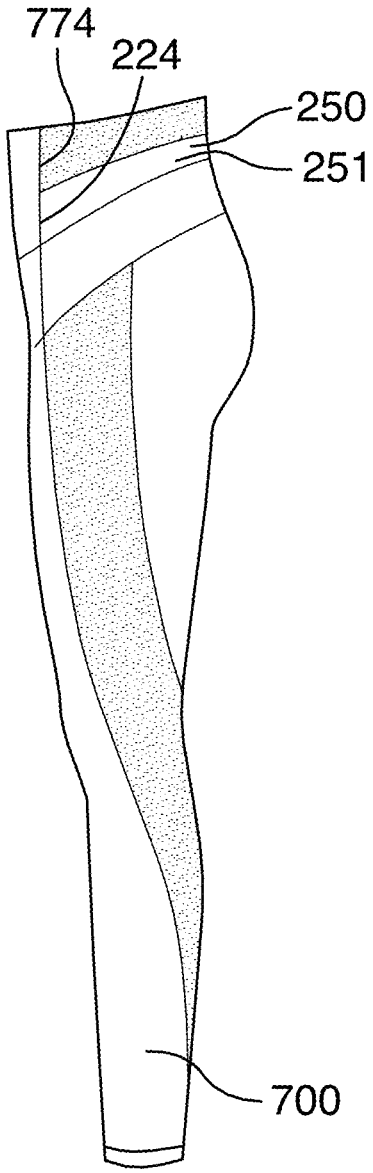
FIG. 10 is a right side view thereof, the left side view being a mirror image thereof.

FIG. 8 is a front view illustrating another example of a garment (or lower body garment) 700 having a waistband 200, the waistband 200 having a loop 775 formed on the back portion 220 thereof. FIG. 9 is a rear view thereof. FIG. 10 is a right side view thereof, the left side view being a mirror image thereof. And, FIG. 11 is a cross-sectional detail view of the back portion 220 of the waistband 200 of the garment 700 of FIG. 8 taken along line B-B in FIG. 9.

As shown in FIGS. 8-10, the waistband 200 of the example garment 700 has a front portion 210 for covering at least a portion of an abdomen area of a wearer, the front portion 210 having a first side 213 and a second side 214, and a back portion 220 for covering at least a portion of a lower back area of the wearer, the back portion 220 having a first side 223 and a second side 224. The first side 223 of the back portion 220 is connected to the second side 214 of the front portion 210 and the second side 224 of the back portion 220 connected to the first side 213 of the front portion 210. The waistband 200 has an outer panel (or liner) 251, an inner panel (or liner) 261, a top edge 201, and a bottom edge 202. The outer panel 251 and the inner panel 261 are connected at least along a portion of the top edge 201 and the bottom edge 202 of the waistband 200.

The waistband 200 has at least one loop panel 770 having a first end (or right end) 773 connected to the outer surface 250 of the back portion 220 and a second end (or left end) 774 spaced apart from the first end 773 and also connected to the outer surface 250 of the back portion 220 forming a loop 775 extending parallel to at least respective portions of the top edge 201 and the bottom edge 202 of the waistband 200.

Figure 11:
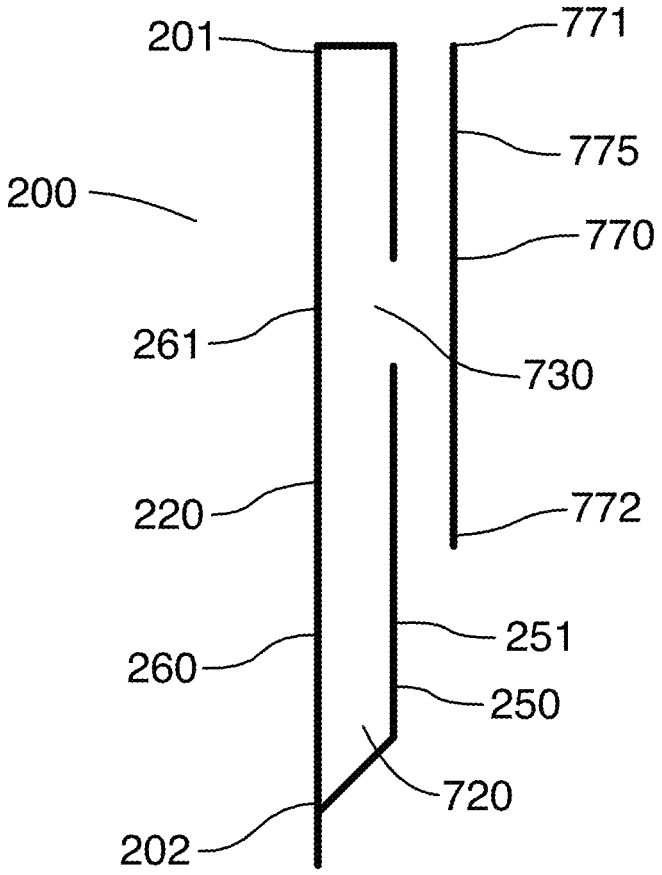
FIG. 11 is a cross-sectional detail view of the back portion of the waistband of the garment of FIG. 8 taken along line B-B in FIG. 9.

As shown in FIG. 11, a pocket space (or storage means or pocket or pocket bag) 720 is formed between the outer panel (or liner) 251 and the inner panel (or liner) 261. The outer panel 251 has an entrance opening 730 formed therein to provide access to the pocket space 720, the entrance opening 730 being concealed by at least a portion of the loop panel 770. Top and bottom edges 771, 772 of the loop 775 may be left open (i.e., not attached) across at least respective portions of the back portion 220 of the waistband 200 to provide access to the pocket space 720 located thereunder. In one embodiment, the entrance opening 730 may be formed along a portion of the top edge 201 of the back portion 220 of the waistband 200 and may be concealed by an upper portion of the loop panel 770. The pocket space 720 may extend throughout a whole width of the waistband 200 such that at least a portion of the bottom edge 202 of the waistband 200 also forms a bottom edge of the pocket 720.

In some embodiments, one or more features of the garment 700 of FIGS. 8-11 may be incorporated in the garment 100 of FIGS. 1-7, and vice versa.

According to one embodiment, the outer and inner panels, pocket panels, and lining of the waistband 200 and garment 100, 700 may be made from or include a stretchable, elastic fabric such as Nulux™, Lycra™, Luxtreme™, Luon™, spandex, elastane, or the like.

Advantageously, the loops 175, 185, 775 not only conceal the pocket entrance openings 330, 360, 730 but also help to retain items in the storage means (or pockets) 320, 350, 720 during exercise, sports, yoga, or other activities engaged in by the wearer. The loops 175, 185, 775 may also be used to hang the garment 100, 700 for storage. The loops 175, 185, 775 may also be used by a wearer to pull the garment 100, 700 on and off the wearer's body. Furthermore, the loops 175, 185, 775 may be used to secure and carry a towel or article of clothing such as a shirt, jacket, or the like. The curved top edge 201 of the waistband 200 at the waist opening 500 of the garment 100 provides for improved fit around the wearer's waist.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this application are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Any example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A waistband for a garment, comprising:

a front portion for covering at least a portion of an abdomen area of a wearer, the front portion having a first side and a second side;

a back portion for covering at least a portion of a lower back area of the wearer, the back portion having a first side and a second side, the first side of the back portion connected directly to the second side of the front portion and the second side of the back portion connected directly to the first side of the front portion;

the waistband having a top edge and a bottom edge, the waistband having an outer panel and an inner panel, the outer panel and the inner panel being connected at least along a portion of the top edge and the bottom edge;

a loop panel having a first end connected to an outer surface of the back portion and a second end spaced apart from the first end and connected to the outer surface of the back portion forming a loop, the loop panel extending parallel to and spaced from at least respective portions of the top edge and the bottom edge of the waistband, the loop panel positioned between the top edge and the bottom edge of the waistband and not extending over the top edge of the waistband; and, a pocket space formed between the outer panel and the inner panel having a horizontal entrance opening to provide access to the pocket space, the entrance opening being concealed by at least a portion of the loop panel.

2. The waistband for a garment of claim 1, wherein the entrance opening is formed in the outer panel below the top edge.

3. The waistband for a garment of claim 1, wherein the outer panel and the inner panel are connected along the top edge and the bottom edge.

4. The waistband for a garment of claim 1, wherein the first end of the loop panel is connected to the outer surface of the back portion at the first side of the back portion and wherein the second end of the loop panel is connected to the outer surface of the back portion at the second side of the back portion.

5. The waistband for a garment of claim 1, wherein top and bottom edges of the loop panel are left open, or not attached, across at least respective portions of the back portion of the waistband.

6. The waistband for a garment of claim 1, wherein the garment is a lower body garment.

7. The waistband for a garment of claim 1, wherein the garment is a pair of tights, shorts, or pants.

* * * * *